US005421901A

United States Patent [19]

Whitney et al.

[11] Patent Number: 5,421,901

[45] Date of Patent: Jun. 6, 1995

[54] METHOD AND APPARATUS FOR CLEANING A WEB

[75] Inventors: Roger A. Whitney, Stanmore; Raymond J. Cox, Ruislip, both of United Kingdom

[73] Assignee: Eastman Kodak Company, Rochester, N.Y.

[21] Appl. No.: 303,565

[22] Filed: Sep. 9, 1994

Related U.S. Application Data

[63] Continuation of Ser. No. 164,309, Dec. 8, 1993, abandoned, which is a continuation of Ser. No. 920,489, filed as PCT/EP91/00283, Feb. 11, 1991, published as WO 91/12095, Aug. 22, 1991, abandoned.

[30] Foreign Application Priority Data

Feb. 14, 1990 [GB] United Kingdom ..... 9003283

[51] Int. Cl.[6] ..... B08B 1/02; B08B 5/00; B08B 6/00

[52] U.S. Cl. ..... 134/15; 134/1; 15/1.51

[58] Field of Search ..... 134/1, 15; 15/1.51

[56] References Cited

U.S. PATENT DOCUMENTS

| | | | |
|---|---|---|---|
| 2,920,987 | 1/1958 | Landry et al. | 134/1 |
| 2,980,993 | 4/1961 | Schwartz | 15/1.5 |
| 3,523,319 | 8/1970 | Stoever | 15/1.51 |
| 3,536,528 | 10/1970 | De Geest | 134/1 |
| 4,213,167 | 7/1980 | Cumming et al. | 361/213 |
| 4,241,377 | 12/1980 | Cumming | 361/213 |
| 4,454,621 | 6/1984 | Testone | 15/1.5 |
| 4,727,614 | 3/1988 | Swistun | 15/1.5 |
| 4,835,808 | 6/1989 | Hahne et al. | 15/1.51 |

FOREIGN PATENT DOCUMENTS 472819 8/1975 U.S.S.R. .

*Primary Examiner*—Michael Lewis
*Assistant Examiner*—Zeinab El-Arini
*Attorney, Agent, or Firm*—Carl F. Ruoff

[57] ABSTRACT

The present invention is a method and apparatus for non-contact cleaning of a web. The method and apparatus involves producing alternating electrostatic forces to separate particles from the surface of the web. The apparatus utilizes an electrode to produce a corona discharge in a gap formed between the electrode and the surface of the moving web being treated. An air supply arrangement is provided to supply air to and remove air from the gap to remove the particles which have been lifted from the surface of the web due to the corona discharge.

12 Claims, 2 Drawing Sheets

METHOD AND APPARATUS FOR CLEANING A WEB

This is a continuation of application Ser. No. U.S. 08/164,309, filed Dec. 8, 1993, now abandoned which is a continuation of application Ser. No. 07/920,489, filed as PCT/EP91/00283, Feb. 11, 1991, published as WO 91/12095, Aug. 22, 1991, now abandoned.

FIELD OF THE INVENTION

This invention relates to web cleaning apparatus, and is more particularly concerned with non-contact web cleaning apparatus.

BACKGROUND OF THE INVENTION

In known non-contact web cleaners, clean air at high velocity is passed over the surface of the web to remove debris. It is also known to utilise electrostatic charges to neutralise the charge which may be attracting the debris or dirt to the surface of the web.

U.S. Pat. No. 2,920,987 describes an arrangement which can be used to clean the surface of a non-conducting material. A high alternating voltage supply is applied to the material by means of an electrode positioned adjacent one surface of the web. This alternating voltage damps out the static charge present on the surface of the material due to a previous operation, for example, a grinding operation. Arranged on the opposite side of the material to the electrode is a series of projections which contact the material. Particles on the material after the grinding operation, say, are removed due to the electrostatic effect produced by the electrode and the physical contact of the projections with the material itself. Loosened particles are removed from the surface of the material by suction.

Another arrangement in which alternating voltages are used to assist in the removal of particles from the surface of a web is described in U.S. Pat. No. 2,980,933. In this arrangement, the web is passed through two static electrostatic fields of opposite charge, an air stream being used to remove the particles loosened by the oppositely charged electrostatic fields.

U.S. Pat. No. 4,213,167 discloses an arrangement in which both surfaces of a web are cleaned by causing air to flow over both surfaces, and introducing ions into the air flow to neutralise static charge on the web. Other examples of the use of ionised air streams to remove dust are disclosed in U.S. Pat. Nos. 4,454,621 and 4,241,377.

U.S. Pat. No. 4,835,808 discloses an arrangement which utilises both suction and blowing to remove particles from the surface of a web. A field plate is also used to charge the web and an electrode is used to discharge the web thereby removing the particles. U.S. Pat. No. 3,536,528 also discloses the use of suction and blowing to remove particles from the surface of a web, but in this case, the charge on the web is neutralised after cleaning.

In arrangements which utilise air at high velocity to remove loosened particles from the surface of a web, there is a lower limit to the size of particle which can be removed. This limit is due to the thickness of the boundary layer produced over the surface of the web by the high velocity air stream. The thickness of the boundary layer can be reduced by increasing the air velocity, but a practical limit is approximately 30 mm on a smooth surface and more than this on a rough one.

French Patent Specification FR-A-2179707 discloses apparatus and method for cleaning glass sheets. Electrostatic charge is generated on the sheet by means of corona discharge as it passes between two electrode strips arranged transverse to the direction of motion of the glass sheets, each strip having a plurality of needle electrodes arranged along its length. These electrode strips are used to discharge particles adhering to the glass sheet and once discharged, the particles are removed using an airstream.

Web cleaners which use ions to discharge the electrostatic charges holding particles against the surface of the web are only effective at low web speeds. However, this may prevent particles being reattracted to the web after they have been loosened.

It is therefore an object of the present invention to provide improved web cleaning apparatus which produces sufficient force using alternating electrostatic fields to separate particles from the surface of the web, in the boundary layer region, so that they can be removed from the surface of the web.

SUMMARY OF THE INVENTION

According to one aspect of the present invention, there is provided a method of cleaning web material comprising the steps of:- passing the web through an air gap, producing a corona discharge across the air gap to generate electrostatic forces on the web and on the particles to cause at least some of the particles to lift off the surface of the web, and removing particles from the web, characterized in that the air gap is defined by a first surface over which the web passes, the web being supported by the first surface, and a second surface spaced from the first surface.

Preferably, the corona discharge is produced by an alternating voltage supply.

According to a second aspect of the present invention, there is provided web cleaning apparatus for use in a method as described above which comprises:- a first surface, a second surface spaced from the first surface and defining an air gap therebetween, generator means for producing a corona discharge in the air gap, and means for removing particles loosened by the corona discharge, characterized in that the first surface supports the web as it passes through the air gap.

At least one of the first and second surfaces is an insulating surface so that the corona discharge does not only occur at a single point.

The generator means may be a high voltage alternating supply.

Once the particles have been loosened, they can be removed using a high velocity air stream. Additionally, or alternatively, suction means can be used to remove the loosened particles.

In a preferred arrangement, the generator means operates at a frequency between 1 to 5 kHz.

BRIEF DESCRIPTION OF THE DRAWINGS

For a better understanding of the present invention, reference will now be made, by way of example only, to the accompanying drawings in which:-

DETAILED DESCRIPTION OF THE PREFERRED EMBODIMENTS

The present invention aims to deposit a significant charge of one sign on the web and then subject it to an electric field of the opposite sign to produce a force to dislodge particles from the surface of the web. Particles so dislodged can then be removed by an air stream passing over the surface of the web, or by suction applied to the web surface.

Figure 1:
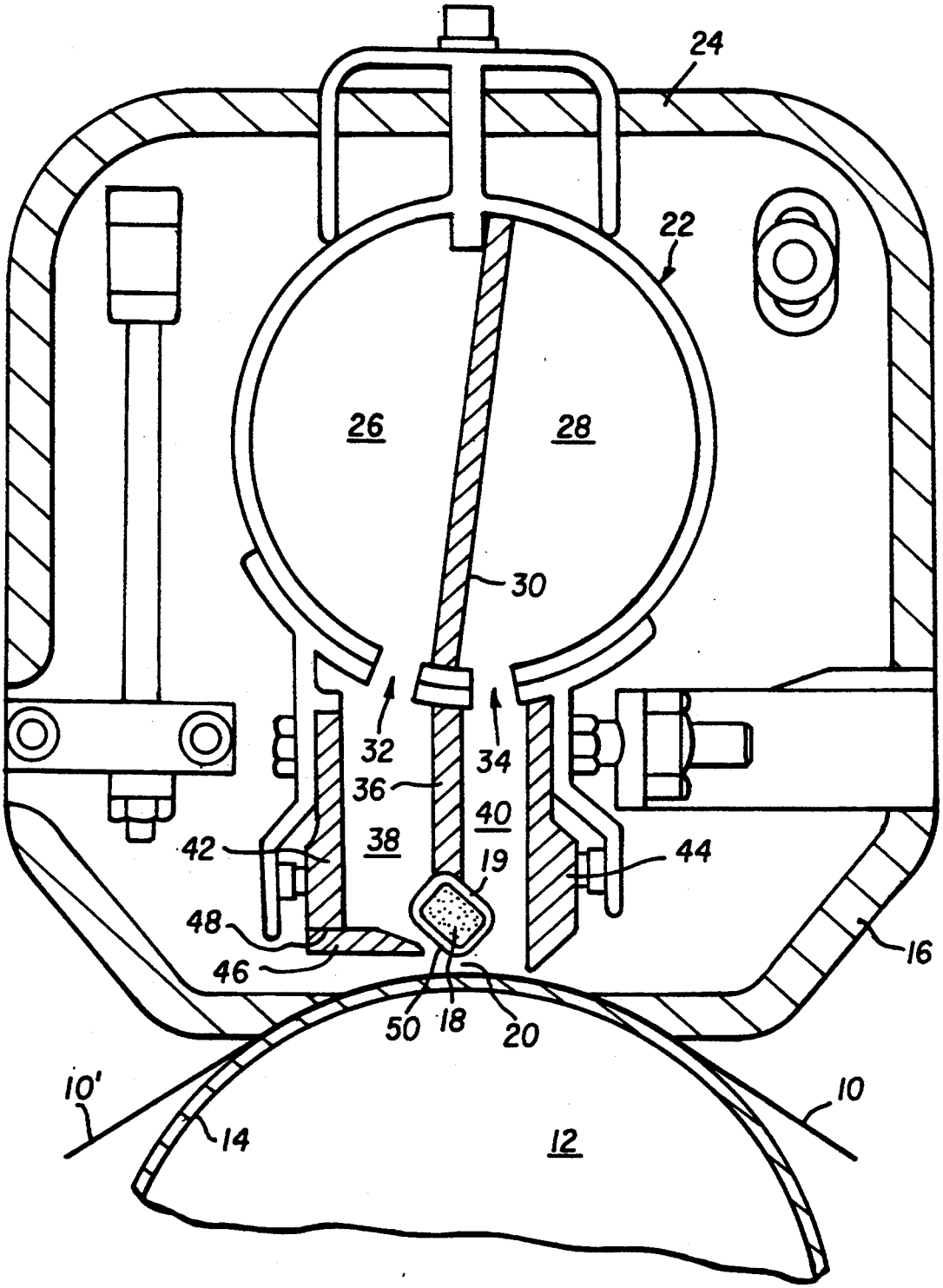
FIG. 1 illustrates one embodiment of web cleaning apparatus according to the present invention.

The apparatus shown in FIG. 1 comprises a cylinder 12 over which a web 10 to be cleaned is passed. The surface of the cylinder 12 has a layer 14 of insulating material placed on it. The rest of the apparatus is positioned above the cylinder 12, and is mounted in a housing 16. An electrode 18 is positioned above the cylinder 12 so that the web 10 passes through a gap 20 formed between the cylinder 12 and the electrode 18. The electrode 18 has an insulating surface 19, and is connected to a high voltage alternating supply (not shown) which causes a corona discharge to occur in the gap 20.

In other applications, the insulating surface 19 and the layer 14 may not be required, the insulating surface being provided by the web itself.

An air supply arrangement 22 for supplying air to and removing air from the gap 20 is attached to an upper wall 24 of the housing 16 as shown. The arrangement 22 comprises a blower section 26 and a suction section 28 positioned adjacent one another with a dividing wall 30 therebetween. Each section 26, 28 has a respective opening 32, 34 which allows the passage of air into and out of that section.

The arrangement 22 also provides a means of positioning the electrode 18 above the surface of the cylinder 12. An insulating support member 36 is attached at one end to the arrangement 22 and at the other to the electrode. The support member 36 is positioned between the openings 32, 34 thereby forming two ducts 38, 40, with further walls 42, 44. The walls 42, 44 are also made of insulating material so that the ducts 38, 40 so formed are non-conducting.

A member 46 is attached to the lower end 48 of wall 42 and extends perpendicularly to it. The member 46, in conjunction with the electrode 18, forms an air jet 50 through which air is directed towards the gap 20.

The apparatus operates as follows:

An alternating high voltage is applied to the electrode 18. Charging of the web and the production of forces into and away from the surface of the web occurs each half cycle of the alternating applied voltage.

As the voltage approaches its maximum absolute value, the strength of the electric field exceeds the breakdown strength for the air in the air gap 20, and a charge of the same sign as the applied electrode voltage is deposited on the surface of the web 10.

While the applied electrode voltage decreases from its maximum absolute value, a force is produced into the web.

When the applied voltage starts to increase (having changed sign), a force away from the surface of the web is produced. This force continues until enough charge has been deposited on the surface of the web to neutralise the previously deposited charge. Charging continues until the next maximum absolute value of applied voltage is reached. This charging provides the charge necessary to produce the forces into and away from the surface of the web during the next half cycle.

The electrostatic forces produced by the alternating voltage cause at least some of the particles attached thereto to lift off the surface of the web 10, so that they can then be removed by air supplied to the surface of the web through the air jet 50, and removed from that surface by the suction section 28 of the air supply arrangement 22. The relationship between the alternating voltage waveform and the removal of particles from the surface of the web 10 is shown in FIG. 2.

Figures 2A, 2B, 2C:
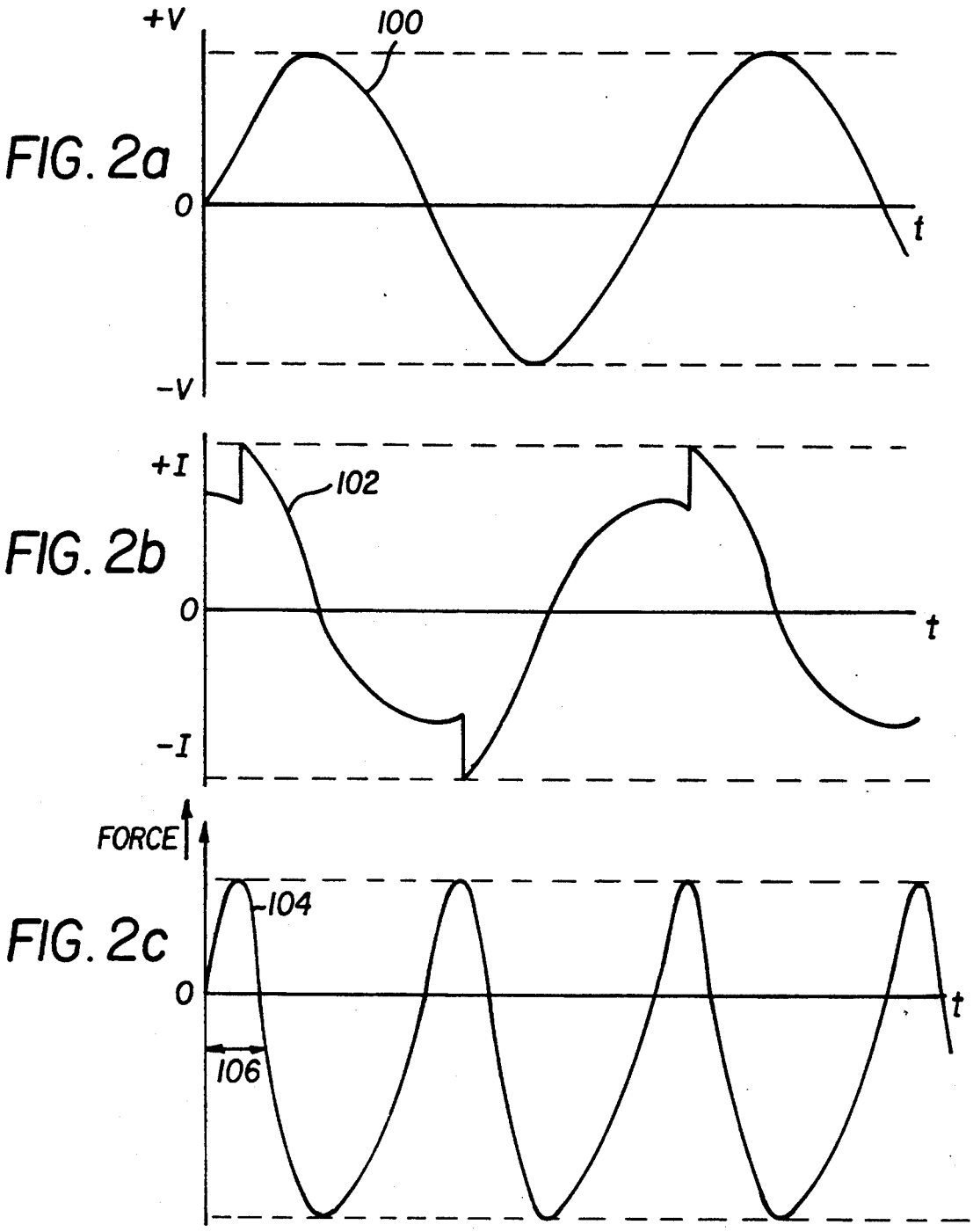
FIG. 2 shows graphically the relationship between an alternating voltage waveform, electrode current, and force on the surface of a web.

In FIG. 2, an alternating voltage waveform 100 is shown. In this case, a regular sinusoidal waveform is shown but any other suitable alternating waveform can be used. A current waveform 102 and a force 'waveform' 104 are also shown. The waveforms 102 and 104 are depicted on the same time scale as the voltage waveform 100.

There are periods, indicated as 106, which due to the electrostatic forces acting away from the surface of the web, cause the particles to lift off the surface of the web 10.

The alternating voltage supply (not shown) is chosen to have a voltage which produces an electric field to loosen the particles from the surface of the web, the voltage having a maximum value to produce an electric field exceeding the breakdown strength of the air in the air gap 20. The electrode 18 is shaped so that breakdown occurs along the entire width of the web 10, and the corona discharge produced in the gap 20 is not concentrated at one point only.

The gap 20 is small, preferably less than 4 mm, but any suitable value can be chosen according to the particular arrangement of the apparatus. The size of the air gap is determined by known parameters which affect the production of a corona discharge.

The alternating high voltage supply is chosen to have a frequency which is of several kHz, preferably in the range of 1 to 5 kHz, although other frequencies may be workable according to the particular embodiment of the apparatus. The frequency of the alternating voltage is related to the speed of the web. For the apparatus to work, the web must be under the electrode for at least half a cycle of the alternating voltage. However, it is preferred that the web is under the electrode for more than 2 cycles. With this in mind, lower frequencies can be used if the web is moving at a compatible speed.

The alternating voltage may have a regular sinusoidal waveform or it may have one of many other waveforms. In order for the apparatus to work effectively, the voltage supplied to the electrode should have:

a) a period of time when the voltage is suitable to allow the electrostatic forces (which cause the loosening of the particles) to take effect, and b) a period of time when the voltage is suitable to produce a corona discharge thereby charging the surface of the web.

Because of these two requirements, an alternating square waveform cannot be used.

Although web cleaning apparatus according to the present invention is described with reference to a web which passes over a cylinder, the apparatus can be used equally well in an arrangement in which the web passes over a flat surface.

We claim:

1. A non-contacting method of cleaning a web material having particles attached thereto, the method comprising the steps of:

a) passing the web material through an air gap being defined by a first surface over which the web material passes and is supported thereby, and a second surface spaced from the first surface;

b) producing a corona discharge across the air gap by applying a voltage to the second surface to generate electrostatic forces on the web material and on the particles attached thereto so as to cause at least some of the particles to lift off the surface of the web material wherein the second surface and the web are not contacting; and c) removing the particles from the web material.

2. A method according to claim 1, wherein the corona discharge is produced by an alternating voltage supply.

3. A method according to claim 1, wherein particles are removed from the web material by an air stream.

4. A method according to claim 3, wherein the air stream is generated by suction.

5. A method according to claim 1, wherein at least one of the first surface and second surfaces is an insulating surface.

6. A method according to claim 1, wherein the web material constitutes an insulating surface.

7. A non-contacting web cleaning apparatus comprising:

a first surface over which a web material passes and is supported thereby;

a second surface spaced from said first surface wherein an air gap is formed between the second surface and the web wherein the second surface and the web are not contacting;

generator means for applying a voltage to the second surface to produce a corona discharge in the air gap; and means for removing the particles loosened by the corona discharge.

8. Apparatus according to claim 7, wherein at least one of the first and second surfaces is an insulating surface.

9. Apparatus according to claim 7, wherein the generator means is an alternating voltage supply.

10. Apparatus according to claim 7, wherein the means for removing loosened particles is an air stream.

11. Apparatus according to claim 7, wherein the means for removing loosened particles includes suction means.

12. Apparatus according to claim 7, wherein the generator means operates at a frequency between 1 to 5 kHz.

* * * * *